US005815782A

United States Patent [19]

Yokomori et al.

[11] Patent Number: 5,815,782

[45] **Date of Patent: *Sep. 29, 1998**

[54] DEVELOPING APPARATUS

[75] Inventors: Kanji Yokomori, Odawara; Shigeo Miyabe, Numazu, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 685,508

[22] Filed: Jul. 24, 1996

[30] Foreign Application Priority Data

Jul. 26, 1995 [JP] Japan ..... 7-209344

[51] Int. Cl.[6] ..... G03G 15/08

[52] U.S. Cl. ..... 399/285

[58] Field of Search ..... 399/222, 252, 399/265, 279, 270, 271, 285, 286

[56] References Cited

U.S. PATENT DOCUMENTS 5,196,889 3/1993 Ronnenberg et al. ..... 399/270

FOREIGN PATENT DOCUMENTS 0 549 400 6/1993 European Pat. Off. .
0 586 033 3/1994 European Pat. Off. .
0 586 043 3/1994 European Pat. Off. .
0 691 589 1/1996 European Pat. Off. .
6-317981 11/1994 Japan .

OTHER PUBLICATIONS

Patent Abstracts of Japan, vol. 95, No. 2, Mar. 31, 1995, relating to JP–A–06 317981, Nov. 15, 1994.

*Primary Examiner*—S. Lee
*Attorney, Agent, or Firm*—Fitzpatrick, Cella, Harper & Scinto

[57] ABSTRACT

A developing apparatus includes a rotatable developer carrying member for carrying a developer; an electrode to be supplied with a bias voltage; a coil spring, provided in an end portion of the developer carrying member, for electrical connection between the electrode and the developer carrying member.

9 Claims, 6 Drawing Sheets

DEVELOPING APPARATUS

FIELD OF THE INVENTION AND RELATED ART

The present invention relates to a developing device usable with an image forming apparatus such as a copying machine or a printer.

In an image forming apparatus using an electrophotographic method or an electrostatic recording method, it is known that a developing bias voltage is applied to a developing sleeve to develop an electrostatic image on an image bearing member using force of an electric field.

It is also known that in order to apply the bias voltage to a rotating developing sleeve, a leaf spring is urged to a developing sleeve end portion to provide a sliding contact.

However, in the case that the rotational speed of the developing sleeve is high, the reliability of energization decreases, and the elasticity of the leaf spring is deteriorated due to long term use, with the result of electric power supply malfunction.

SUMMARY OF THE INVENTION

Accordingly, it is a principal object of the present invention to provide a developing device wherein the developing bias voltage can be applied to the developer carrying member stably for a long term.

According to an aspect of the present invention, there is provided a developing apparatus includes a rotatable developer carrying member for carrying a developer; an electrode to be supplied with a bias voltage; a coil spring, provided in an end portion of the developer carrying member, for electrical connection between the electrode and the developer carrying member.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Referring to the accompanying drawings, the embodiments of the present invention will be described.

Figure 1:
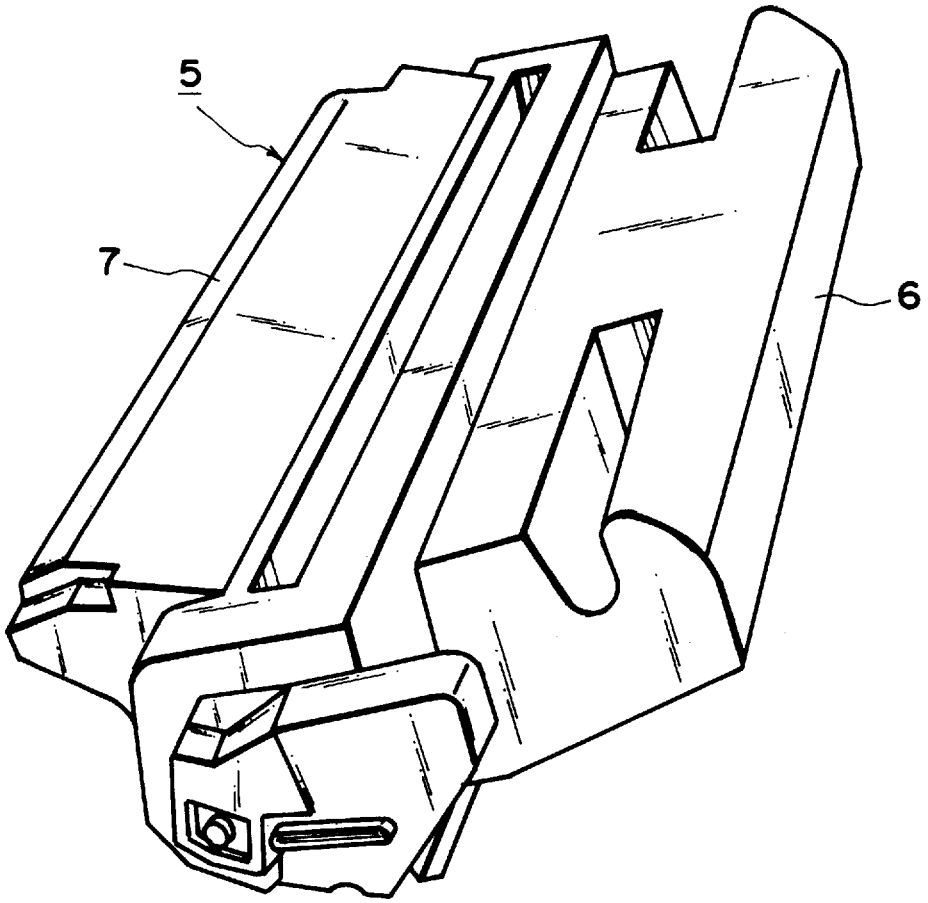
FIG. 1 is an illustration of outer appearance of a process cartridge having a developing device of an embodiment of the present invention.
Figure 2:
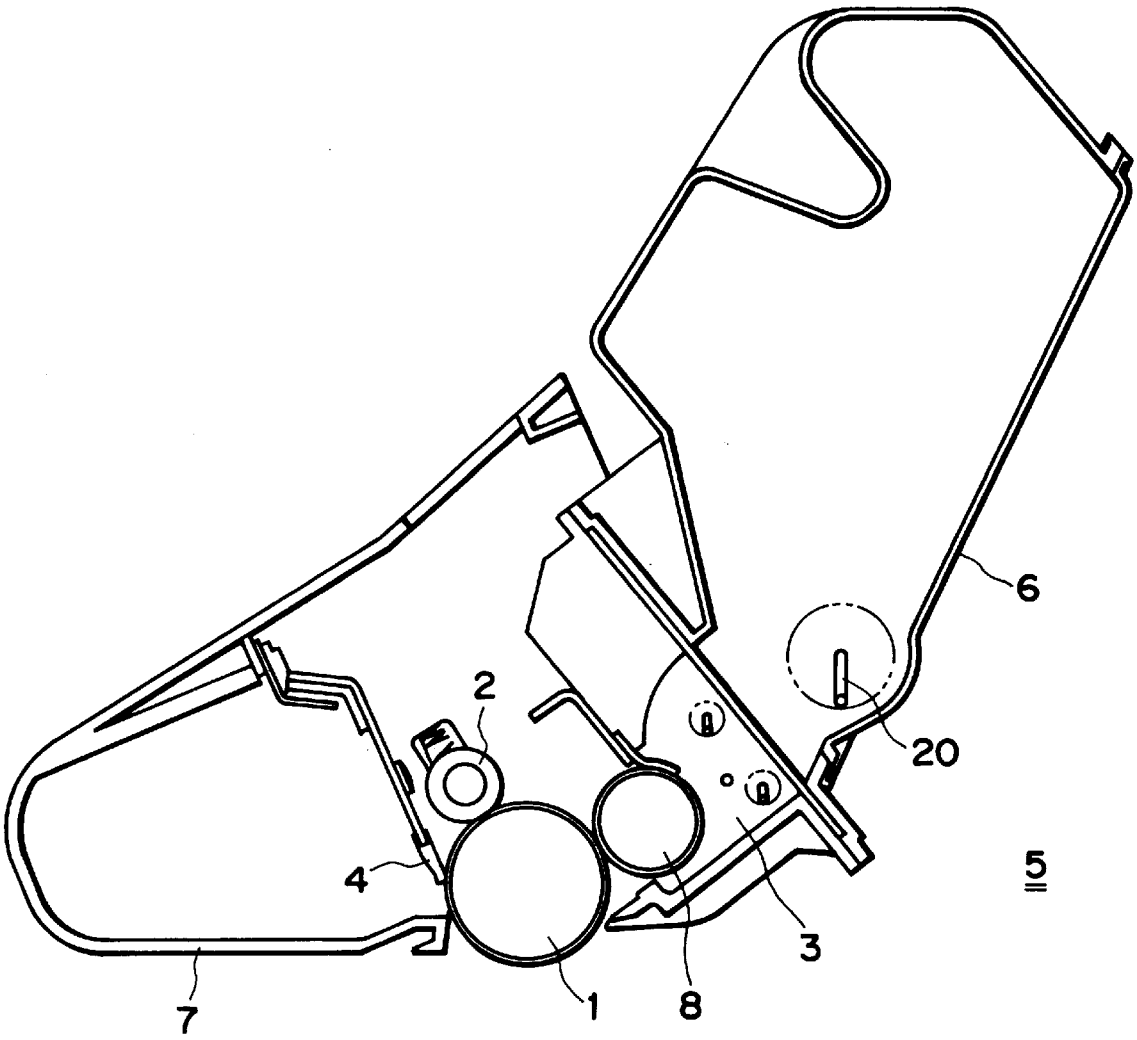
FIG. 2 is a sectional view of the process cartridge of FIG. 1.

FIG. 1 is a perspective view of a process cartridge having a developing device of an embodiment of the present invention as an unit integral with an image bearing member. FIG. 2 is a sectional view of the process cartridge of FIG. 1, and FIG. 3 is a partial enlarged sectional view of the developing device.

The process cartridge is an unit detachably mountable to an image forming apparatus, and contains at least an image bearing member and a developing device. It may contain an additional process means.

Here, examples of process means include charging means for charging a surface of the image bearing member, and cleaning means for removing toner remaining on the surface of the image bearing member. In this example, the process cartridge, as shown in FIG. 2, contains the electrophotographic photosensitive drum 1 as the image bearing member, and charging means 2, developing device 3 accommodating developer and cleaning means 4, around the electrophotographic photosensitive drum 1, which are covered by a housing comprising frames 6 and 7, so that it is detachably mountable as a unit relative to the main assembly of the image forming apparatus.

Figure 3:
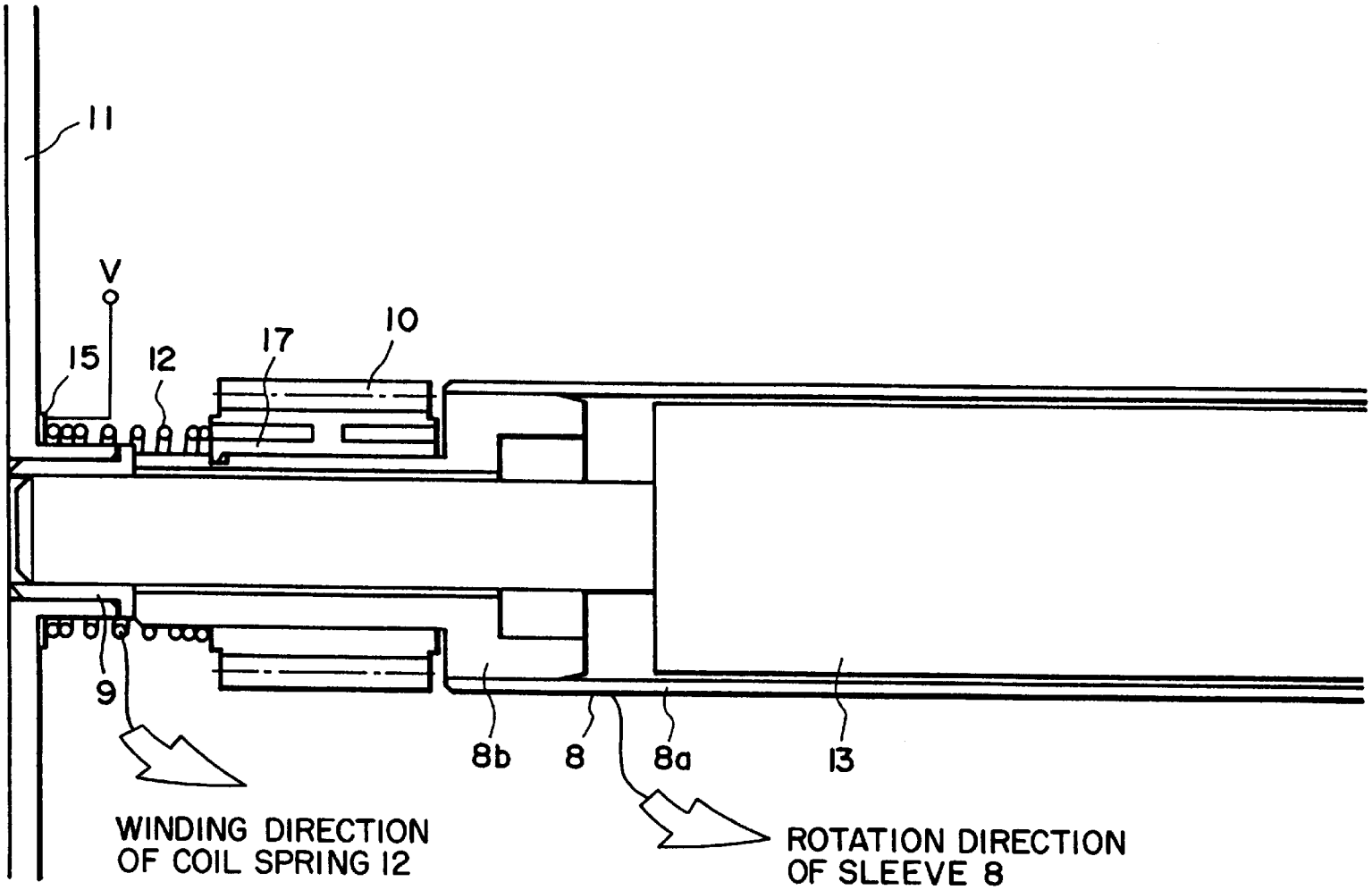
FIG. 3 is an illustration of a thrust receptor for a developer carrying member in the process cartridge of FIG. 1.

The developing device 3 in the process cartridge 5, as shown in FIG. 3, includes a developing sleeve 8, as the developer carrying member, of metal such as aluminum or stainless steel, and the developing sleeve 8 encloses a magnet roller 13.

The developing sleeve 8 comprises a pipe-like sleeve 8*a* and a flange 8*b*.

The flange 8*b* at a driving side is of electroconductive stainless steel, aluminum, electroconductive resin material or the like to permit electric energy supply to the sleeve 8*a* of aluminum or stainless steel, and is of aluminum in this example since it is good in dimensional accuracy and durable.

To one of the axial end portions of the developing sleeve 8, a sleeve gear 10 of molded POM (polyacetal), sliding material containing POM, polycarbonate, sliding material containing polycarbonate, Nylon or another resin material, is mounted by an axial snap fit of a claw 17, so as to be rotatable integrally with the developing sleeve 8.

The sleeve gear 10 is in a meshing engagement with a helical gear (not shown) of the photosensitive drum 1 shown in FIG. 2 to rotate the developing sleeve 8 in accordance with the rotation of the photosensitive drum 1.

However, the sleeve gear 10 is in the form of a helical gear, and therefore, thrust force is produced in one axial direction so that it is biased to the developing device holder 11 side, for example, this example.

When the thrust force tending to shift to the developing device holder 11 side is produced by the sleeve gear 10, the end portion of the developing sleeve 8 is urged to the developing device holder 11, since the sleeve gear 10 is mounted by the axial snap fit.

Therefore, as shown in FIG. 3, at the sliding portions between the developing device holder 11 and the developing sleeve 8, there is provided with a sliding member 9 of molded POM (polyacetal), sliding material containing POM, polycarbonate, sliding material containing polycarbonate, Nylon or another resin material, as a member having a high sliding property. The sliding member 9 is integral with developing device holder 11, and is mounted thereto by press-fitting, bonding, screw stop or the like.

Therefore, the relative sliding occurs between the developing sleeve 8 and the sliding member 9 by the thrust force. By using a material exhibiting high sliding property relative to the developing sleeve 8, smooth sliding is accomplished with suppressed vibration. By the sliding member 9, the angular position of the magnet roller 13 can be determined.

Since the developing sleeve 8 is axially integrally mounted to the sleeve gear 10, the developing sleeve 8 is press-contacted to the sliding member 9 by the thrust force of the sleeve gear 10, so that the position in the axial direction can be maintained constant.

Further, since the use is made with snap fit of the claw 17 to mount the sleeve gear 10 to the developing sleeve 8, as described hereinbefore, the cost can be lower than the conventional ones using an E shaped stop ring or a parallel pin.

The description will be made as to an electric energy supplying structure to the developing sleeve 8. A developing bias voltage is supplied from bias voltage source V to a contact plate 15, which is an electrode plate mounted to the developing device holder 11.

A coil spring 12 is inserted into the end portion of the flange 8*b* of the developing sleeve 8. The coil spring 12 is compressed between the sleeve gear 10 and the contact plate 15 and functions to effect electric power supply to the flange 8*b* from the contact plate 15.

Figure 6:
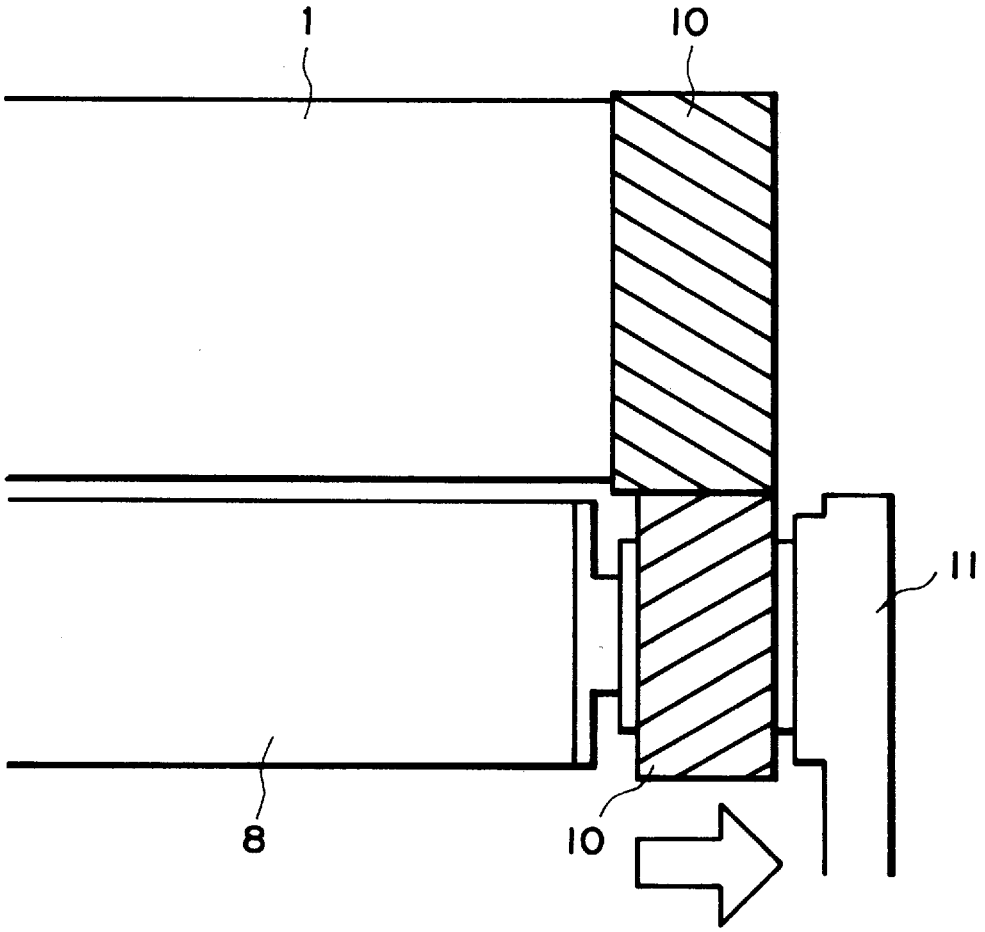
FIG. 6 is a view illustrating a direction of a thrust force of a sleeve gear.

As shown in FIG. 6, the sleeve gear 10 is a helical gear, and the thrust force produced by rotation of the sleeve gear 10, is toward the holder 11 side, that is, to the coil spring 12 side.

Therefore, during rotation of the developing sleeve 8, the coil spring 12 is contacted to the contact plate 15 always at a contact pressure, so that possible contact defect relative to the contact plate 15 can be avoided.

Designated by 1 a is a driving gear of the photosensitive drum.

The coil spring 12 is press-fitted into the flange 8*b* so that is not easily removed.

The inner diameter of the coil spring 12 is preferably 90–99% of the outer diameter of the press-fitting portion of the flange 8*b*.

Figure 7:
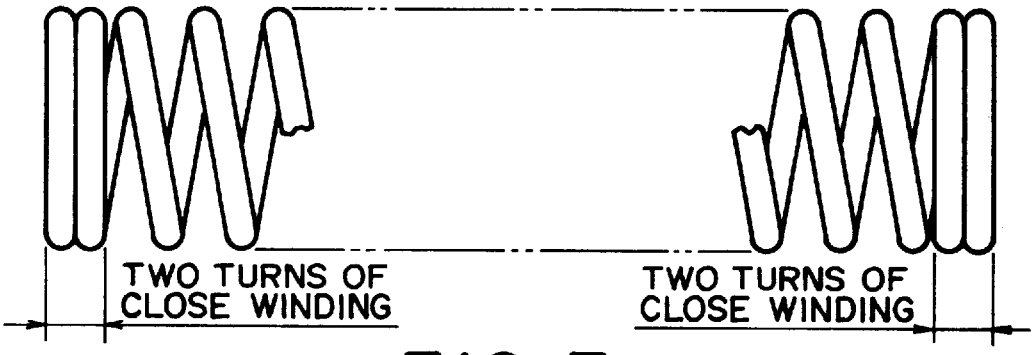
FIG. 7 is a front view of a coil spring.

In order to increase the accuracy of the diameter of the coil spring, the coil spring has a close contact winding end portion, as shown in FIG. 7, in this example.

The close contact winding preferably has 2–5 windings.

The close contact winding portion is provided at least at the press-fitting side end portion of the coil spring, but by providing them at the opposite ends, the assembling operativity is improved.

Further, the winding direction as seen in a direction from the holder 11 to the developing sleeve is the same as the rotational direction of the developing sleeve 8.

Therefore, when the developing sleeve 8 is rotated, the resultant tightening force of the coil spring 12 is produced to assure the contact with the developing sleeve and to avoid the contact defect between the coil spring and the developing sleeve.

The material of the coil spring 12 may be of stainless steel wire, phosphor bronze wire, music wire or anther metal, but phosphor bronze wire is preferable since the sliding noise relative to the contact plate 15 can be reduced.

In this example, magnetic toner is used, and therefore, the developer carrying member is a developing sleeve enclosing the magnet roller, but the present invention is applicable to a developing roller not enclosing the magnet roller.

Figure 4:
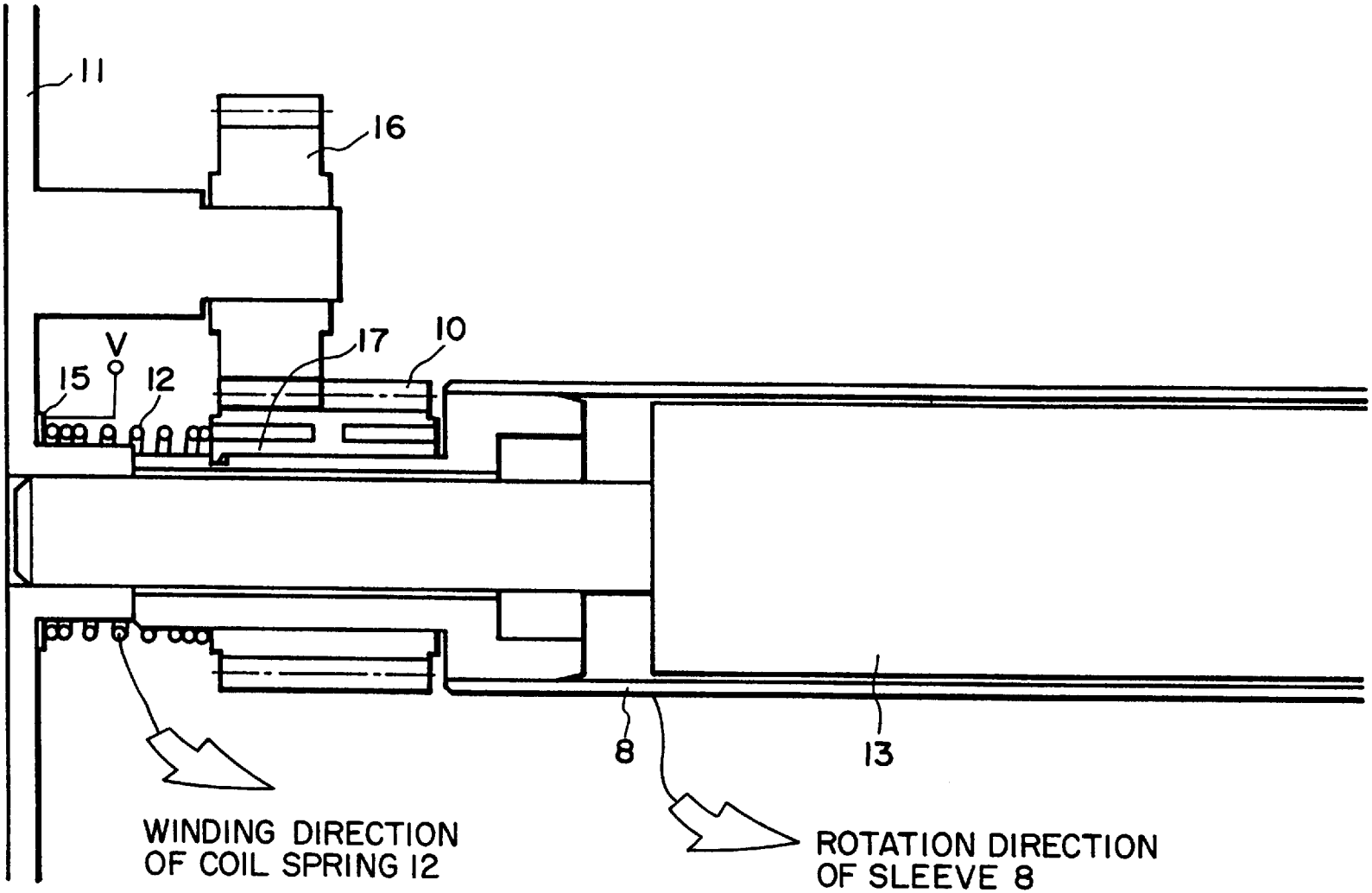
FIG. 4 is an illustration of a thrust receptor of a developer carrying member of a second embodiment of the present invention.

FIG. 4 shows a device of a second embodiment of the present invention.

In this embodiment, the developing device holder 11 is of a member having a high sliding property, for example, molded POM (polyacetal), sliding material containing POM, polycarbonate, sliding material containing polycarbonate, Nylon or the like resin, in place of interposing, between the developing sleeve 8 and the developing device holder 11, a sliding member having high sliding property.

In this example device, the sleeve gear 10 is in a meshing engagement with a stirring gear 16 shown in FIG. 4, which gear is connected with a toner feeding(stirring) member 20 shown in FIG. 2, so as the transmit the rotating force of the photosensitive drum 1 to the toner feeding member 20. The stirring gear 16 is in sliding contact with the developing device holder 11, so that by using the high sliding property member, the stirring gear 16 as well as the developing sleeve 8 can rotate smoothly without wearing.

Figure 5:
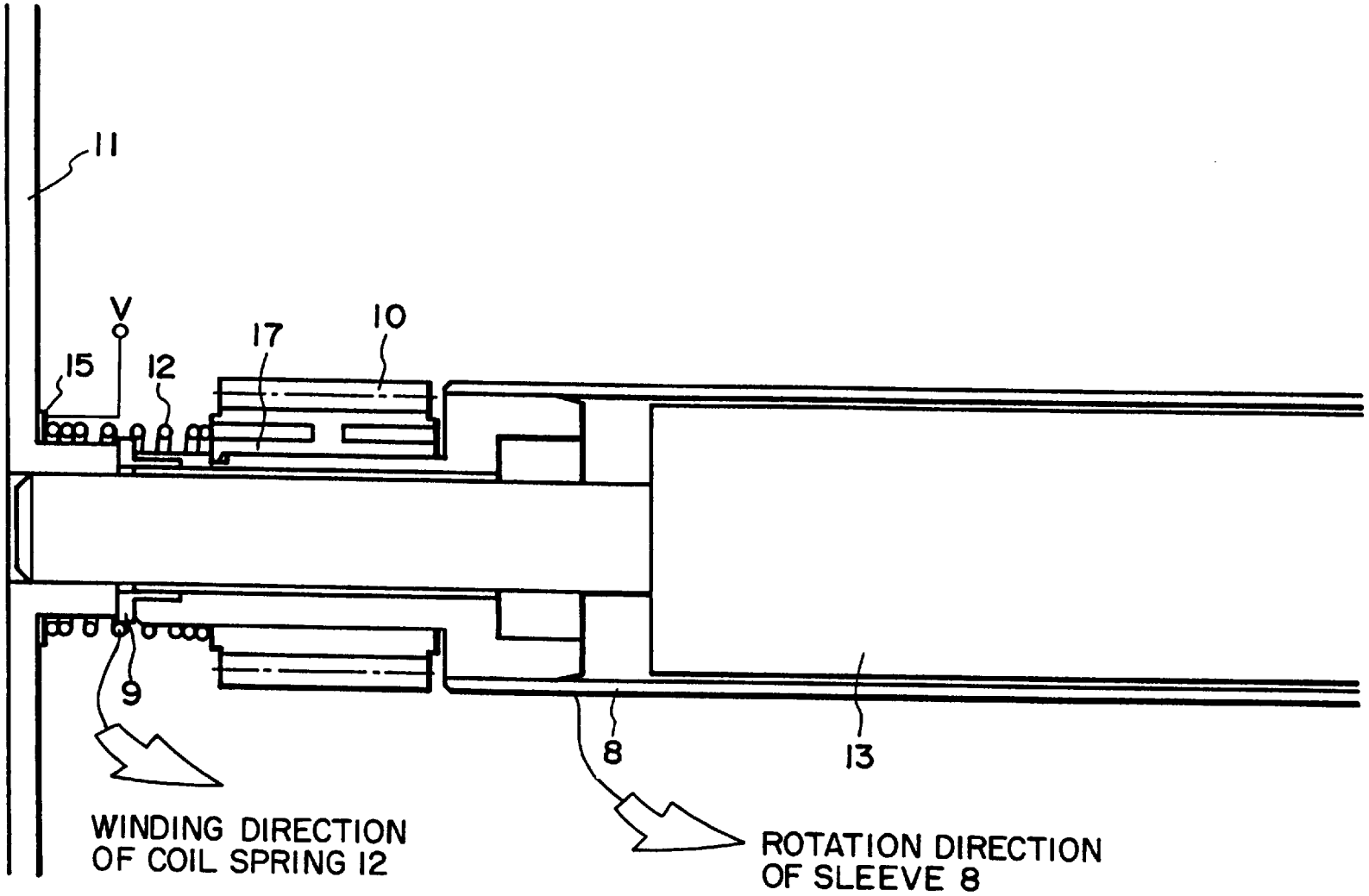
FIG. 5 is an illustration of a thrust receptor for a developer carrying member of a third embodiment of the present invention.

Referring to FIG. 5, a third embodiment of the present invention will be described.

In this embodiment, a high sliding property sliding member 9 is disposed between the developing sleeve 8 and the developing device holder 11, sliding member 9 being of molded POM (polyacetal), sliding material containing POM, polycarbonate, sliding material containing polycarbonate, Nylon or anther resin material. The sliding member 9 is integral with the developing sleeve 8 by press-fitting, bonding, screw stop or the like.

Since the relative sliding occurs between the developing device holder 11 and the sliding member 9, smoother sliding is accomplished with further reduced vibration by selecting the material of the developing device holder 11 so as to exhibit high sliding property relative to the sliding member 9.

In the each embodiment, the developing device is provided in the process cartridge, but the present invention is applicable to a developing device in an image forming apparatus without use of the process cartridge structure.

According to the present invention, the developing bias can be supplied assuredly for a long term even if the rotational speed of the developer carrying member is high.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a rotatable developer carrying member for carrying a developer;

an electrode to be supplied with a bias voltage; and a coil spring, press-fitted into an end portion of the developer carrying member, for electrical connection between the electrode and the developer carrying member.

2. An apparatus according to claim 1, wherein said apparatus is contained, together with an image bearing member, in a process cartridge as a unit, which is detachably mountable relative to an image forming apparatus.

3. An apparatus according to claim 1, wherein the coil spring has an inner diameter which is 90–99% of an outer diameter of an end portion of said developer carrying member into which said coil spring is press-fitted.

4. A developing apparatus comprising:

a rotatable developer carrying member for carrying a developer;

an electrode to be supplied with a bias voltage; and a coil spring, press-fitted into an end portion of the developer carrying member, for electrical connection between the electrode and the developer carrying member, wherein a winding direction of the coil spring as seen in a direction from the electrode to the developer carrying member is the same as a rotational direction of the developer carrying member.

5. An apparatus according to claim 4, wherein the coil spring has an inner diameter which is 90–99% of an outer diameter of an end portion of said developer carrying member into which said coil spring is press-fitted.

6. A developing apparatus comprising:

a rotatable developer carrying member for carrying a developer;

an electrode to be supplied with a bias voltage; and a coil spring, press-fitted into an end portion of the developer carrying member, for electrical connection between the electrode and the developer carrying member, wherein the coil spring has 2–5 windings of close contact winding portion at each opposite ends thereof.

7. A developing apparatus comprising:

a rotatable developer carrying member for carrying a developer;

an electrode to be supplied with a bias voltage; and a coil spring, press-fitted into an end portion of the developer carrying member, for electrical connection between the electrode and the developer carrying member, further comprising a driving gear for driving the developer carrying member, wherein the coil spring is compressed between the driving gear and the electrode.

8. An apparatus according to claim 7, wherein the driving gear is a helical gear which produces thrust force toward the coil spring by rotation of the driving gear.

9. A developing apparatus comprising:

a rotatable developer carrying member for carrying a developer;

an electrode to be supplied with a bias voltage; and a coil spring, press-fitted into an end portion of the developer carrying member, for electrical connection between the electrode and the developer carrying member, wherein the coil spring is of phosphor bronze.

* * * * *

UNITED STATES PATENT AND TRADEMARK OFFICE

CERTIFICATE OF CORRECTION

PATENT NO. : 5,815,782

DATED : September 29, 1998

INVENTOR(S) : KANJI YOKOMORI, ET AL.

It is certified that error appears in the above-identified patent and that said Letters Patent is hereby corrected as shown below:

Item [56] OTHER PUBLICATIONS

"JP-A-06 317981," shouldread --JP-A-6-317981,--.

COLUMN 1:

Line 30, "includes" should read --including--; and
Line 44, "outer" should read --an outer--.

COLUMN 2:

Line 1, "an unit" should read --a unit--;
Line 5, "an unit" should read --a unit--; and
Line 15, "accommodating" should read --accommodates--.

COLUMN 3:

Line 34, "is" should read --it is--.

COLUMN 4:

Line 9, "the transmit" should read --to- transmit--; and
Line 30, "the each" should read --each--.

UNITED STATES PATENT AND TRADEMARK OFFICE

CERTIFICATE OF CORRECTION

PATENT NO. : 5,815,782

DATED : September 29, 1998

INVENTOR(S) : KANJI YOKOMORI, ET AL.

It is certified that error appears in the above-identified patent and that said Letters Patent is hereby corrected as shown below:

COLUMN 5:

Line 18, "ends" should read --end--.

Signed and Sealed this

Fifteenth Day of June, 1999

Q. Todd Dickinson

Q. TODD DICKINSON

*Acting Commissioner of Patents and Trademarks*

*Attest:*

*Attesting Officer*

Disclaimer 5,815,782—Kanji Yokomori, Odawara; Shigeo Miyabe, Numazu, both of Japan. DEVELOPING APPARATUS. Patent dated September 29, 1998. Disclaimer filed September 14, 2001 by the assignee, Canon Kabushiki Kaisha.

Hereby enter this disclaimer to all claims (1-9) of said patent.

*(Official Gazette, August 13, 2002)*